US011517050B1

(12) United States Patent
Churakov et al.

(10) Patent No.: US 11,517,050 B1
(45) Date of Patent: Dec. 6, 2022

(54) ATOMIZER WITH SEVERAL HEATING SECTIONS

(71) Applicant: HOKORD LIMITED, Sheung Wan (HK)

(72) Inventors: Dmitri Churakov, Opatija (HR); Anatolii Gordovskyi, Kyiv (UA); Yurii Lykhovyd, Kyiv (UA)

(73) Assignee: HOKORD Limited, Sheung Wan (HK)

( * ) Notice: Subject to any disclaimer, the term of this patent is extended or adjusted under 35 U.S.C. 154(b) by 0 days.

(21) Appl. No.: 17/378,727

(22) Filed: Jul. 18, 2021

(51) Int. Cl.
*A24F 40/46* (2020.01)
*A24F 40/44* (2020.01)

(52) U.S. Cl.
CPC ..... *A24F 40/46* (2020.01); *A24F 40/44* (2020.01)

(58) Field of Classification Search
None
See application file for complete search history.

(56) References Cited

U.S. PATENT DOCUMENTS

| | | | | |
|---|---|---|---|---|
| 2019/0001086 | A1* | 1/2019 | Garthaffner | H05B 1/0227 |
| 2019/0104764 | A1* | 4/2019 | Tucker | H05B 3/04 |
| 2019/0174828 | A1* | 6/2019 | Holtz | H05B 3/06 |
| 2022/0110366 | A1* | 4/2022 | Kokadir | A24F 40/46 |
| 2022/0183375 | A1* | 6/2022 | Abi Aoun | A24F 40/465 |

* cited by examiner

*Primary Examiner* — James Harvey
(74) *Attorney, Agent, or Firm* — Inventa Capital PLC

(57) ABSTRACT

The invention relates to an electronic cigarette or electronic cigar, namely to atomizers and liquid heaters for E-liquid evaporation. The technical result of the invention is to obtain a steam mixture of an improved quality level. This solves the problem of preparing a vapor mixture which, when exhaling after a puff of an electronic cigarette by a user, has a high visual imitation of smoke and also provides a sufficient sensation of the taste of a flavoring agent by the user's taste buds thanks to using two or more differentiated heating sections.

17 Claims, 5 Drawing Sheets

ATOMIZER WITH SEVERAL HEATING SECTIONS

FIELD OF INVENTION

The present invention relates generally to the field of vaporizers used to heat liquids and suspensions, consisting of a mixture of glycerin, propylene glycol, flavoring, nicotine, and water.

BRIEF DESCRIPTION OF THE INVENTION

The art is replete with various prior art design of vaping devices. Vaporizers, including electronic cigarettes, have become increasingly popular over the past ten years. As consumers have become more aware of the health consequences of inhaling smoke produced by combusting tobacco and other substances, vaporizers have become a healthier alternative to cigarettes, cigars, pipes and other smoking implements. The typical configuration of a compact vaporizer includes a battery electrically connected to an atomizer housed within the vaporizer. The solid, liquid or suspension material sought to be vaporized is placed in the atomizer, or alternatively placed in a separate housing connected to the atomizer by a wick. The atomizer may include one or more inductive heating coils electrically connected to a generator. When activated, the inductive heating coil heats the so named susceptor and as a result it heats a substance that is in contact with the susceptor and vaporizes that substance so that the user may inhale the resulting vapor.

The purpose of the atomizer is to evaporate part of the liquid that flows through the wick from the container with the liquid to the heating zone through the capillary effect.

Also is known a method and device comprising two different vaporizing liquids. Vaporizing the first liquid can produce a first vapor having a visible vapor cloud. Vaporizing the second liquid can produce a second invisible vapor having suitable aroma.

The purpose of the offered invention consists in that because there is a relationship between the temperature of the heating zone, its active surface area and the amount of evaporated liquid per unit of time. The larger the active surface of the heating means (having direct contact with the wick) and the higher the permissible heating temperature (up to 290 degrees Celsius), the more liquid evaporates per unit of time. When the heating means is at the maximum allowable voltage for the heater, it quickly reaches operating temperature. In this case, the process of evaporation of liquid from that part of the wick, which is located in the heating zone, occurs. The higher the permissible supply voltage is applied to the heating means, the correspondingly it heats up faster, and vaporization occurs most rapidly and actively. During the process of rapid, quantitative vapor generation, so-called cloud vapor can be formed. This type of vapor is characterized by the property of a relatively large number of suspended particles of the evaporated liquid in the aerosol mixture. Cloudy vapor or aerosol has a large visual effect that can be observed when the user exhales a puff previously made by the user. Cloudy vapor creates an imitation of the smoke of a classic cigarette, which is exhaled by a user.

However, when exposed to high temperatures, the aromatic component of the liquid is suppressed, and the aromatic properties of the vapor (aerosol) weaken. To obtain steam (aerosol), in the composition of which the aromatic component, which is responsible for the user's taste sensations when inhaling the steam, it is necessary to provide a heater temperature of about 200-220 degrees Celsius.

Unfortunately, these prior art design present numerous disadvantages including and not limited to redundant parts count that makes its hard to assemble/disassemble. There is always a need for an improved device that is easy to assemble/disassemble and manufacture.

There is a constant need for a compact atomizer that will eliminate drawbacks associated with prior art designs, generate steam is high heating temperature and provide the flavor component of the steam that is not lost from the high heating temperature. To achieve these conditions, a lower supply voltage must be applied to the heater compared to the supply voltage in order to obtain cloud vapor (aerosol).

SUMMARY OF THE INVENTION

According to the present invention an aerosol generating atomizer comprising a power supply, a wick, liquid supply container and a heating zone which comprises two or more resistive heating sections, which may be differentiated from one another. The heating sections may be located in line next to one another and receive liquid from the liquid supply container via the wick common to them.

The heating sections may be located separately from one another in individual housings where the liquid evaporates. Each heating section may have an individual wick, wherein is established a collector common for above mentioned housings. The heating sections are made according to the same type of embodiment but have different electrical parameters that directly affect the different aerosol generation activity. The heating sections are connected in parallel to above mentioned power supply. The heating sections are connected to the power supply alternated by an electronic switch using the method pulse-width modulation.

The heating sections are located diametrically one opposite the other and form a cylindrical heating zone. The wick is made of a ribbon cotton, wound in such a way that it forms a cylinder, the outer cylindrical side of which is washed by above mentioned liquid, and above mentioned heating sections are installed in the inner cylindrical cavity of the wick. The heating sections include a shape of a crescent, when in close contact with one of their planes with the inner surface of the hollow wick. The heating sections are made of sheet metal of a thin 0.01 . . . 0.1 mm sheet metal, in which holes are made, without limiting the scope of the present invention.

The heating sections are made in form of ribbons along edges of which are made cutouts with different shapes forming an integrated 3D structure of differentiated heating sections. The holes are located along the entire plane of the heating sections forming a 3D mesh structure. The holes may have various shapes: round, square, oval, rectangular, curved, slot-like or hexagonal, without limiting the scope of the present invention. The heating sections are supplied of resistance-welded wires leads along the edges and the lead wires function as contact electrodes to which electrical current is applied during heating operation. The wick is made of Silica thread or tape, cotton wool or microporous ceramics.

In the alternative embodiment of the present invention the atomizer present a in tubular form and includes one common wick for all heating sections that is made of thin-walled metal tubes wherein inside is placed a wick, which is hygroscopic and capable of supplying liquid of both sides of tubular heating sections from the liquid supply container using the capillary effect. The contact electrodes of the tubular heating sections are connected to outputs of a high frequency generator to provide a skin-effect on the outer surface of the tubular heating sections.

An advantage of the present invention is to provide an atomizer that is compact in design.

Another advantage of the present invention is to provide an inventive atomizer that will generate steam at a high heating temperature and to provide the flavor component of the steam that is not lost from the high heating temperature.

Still another advantage of the present invention is to provide an inventive atomizer with a heater having two and more heating sections wherein the aerosol is sufficiently saturated with the flavoring component, and the user feels the taste (aroma) of the aerosol inhaled by the user and the aerosol is sufficient in quantitative terms, that is, the user receives a sufficient amount of aerosol when puffing.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1:
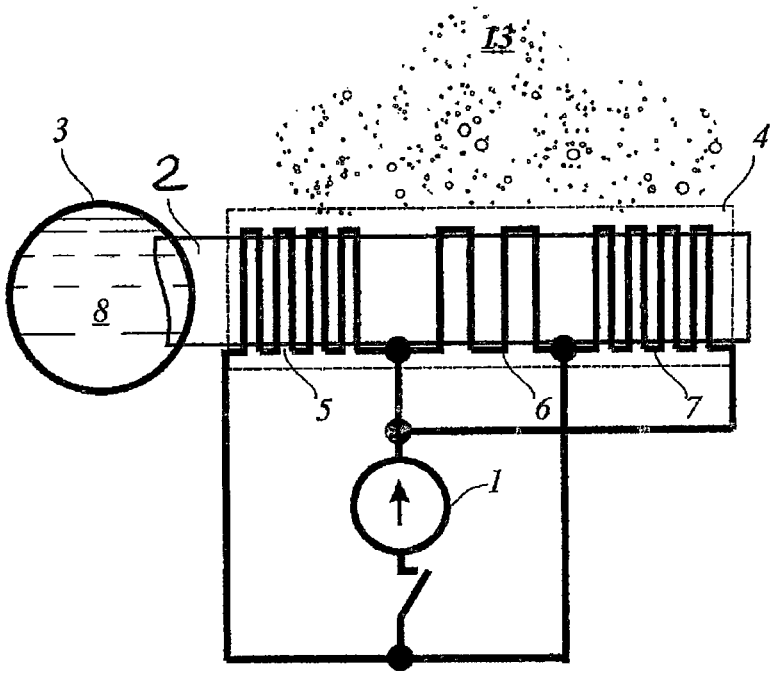
FIG. 1 illustrates a parallel connection of several heating sections with a common wick in offered atomizer of the present invention.

Referring to description of the present invention, the words "inner", "inwardly" and "outer", "outwardly" refer to directions toward and away from, respectively, a designated centerline or a geometric center of an element being described, the particular meaning being readily apparent from the context of the description. Additionally, as used herein, the singular forms "a," "an," and "the" include plural referents unless the context clearly dictates otherwise.

Thus, for example, the term "module" is intended to mean one or more modules or a combination of modules. Furthermore, as used herein, the term "based on" includes based at least in part on. Thus, a feature that is described as based on some cause, can be based only on that cause, or based on that cause and on one or more other causes.

It will be apparent that multiple embodiments of this disclosure may be practiced without some or all of these specific details. In other instances, well-known process operations have not been described in detail in order not to unnecessarily obscure the present embodiments. The following description of embodiments includes references to the accompanying drawing. The drawing shows illustrations in accordance with example embodiments.

These example embodiments, which are also referred to herein as "examples," are described in enough detail to enable those skilled in the art to practice the present subject matter. The embodiments can be combined, other embodiments can be utilized, or structural, logical and operational changes can be made without departing from the scope of what is claimed. The following detailed description is, therefore, not to be taken in a limiting sense, and the scope is defined by the appended claims and their equivalents.

Alluding to the above, for purposes of this patent document, the terms "or" and "and" shall mean "and/or" unless stated otherwise or clearly intended otherwise by the context of their use. The term "a" shall mean "one or more" unless stated otherwise or where the use of "one or more" is clearly inappropriate. The terms "comprise," "comprising," "include," and "including" are interchangeable and not intended to be limiting. For example, the term "including" shall be interpreted to mean "including, but not limited to."

Accordingly, as used herein, terms such as "identifier of an object" and "memory address of an object" should be understood to refer to the identifier (e.g., memory address) itself or to a variable at which a value representing the identifier is stored. As used herein, the term "module" refers to a combination of hardware (e.g., a processor such as an integrated circuit or other circuitry) and software (e.g., machine- or processor-executable instructions, commands, or code such as firmware, programming, or object code). A combination of hardware and software includes hardware only (i.e., a hardware element with no software elements), software hosted at hardware (e.g., software that is stored at a memory and executed or interpreted at a processor), or at hardware and software hosted at hardware.

Referring now to the drawings and the illustrative embodiments depicted in FIGS. 1 through 7, an aerosol generating atomizer in comprises a power supply 1, a wick 2, a liquid supply container 3, and a heating zone 4, which comprises several resistive heating sections 5, 6, 7. All resistive heating sections may have different electrical parameters. These heating sections 5, 6, 7 may be located in line next to one another and receive liquid 8 from liquid supply container 3 via the wick 2 common to them. The above-mentioned heating sections 5, 6, 7 are connected in parallel to above mentioned power supply 1. In this case, when the electric switch is in the closed position, an electric current flows through all heating sections 5, 6, 7. As a result all heating sections 5, 6, 7 of the electrical circuit with a high resistivity is heated depending on its resistance. Thus, electrical energy is converted into the heat energy A depending to the equation: A=t*U2/r, where t—time duration of the current flow; U—power supply 1 voltage level; r—resistance of corresponding heating section 5, 6 or 7.

Figure 2:
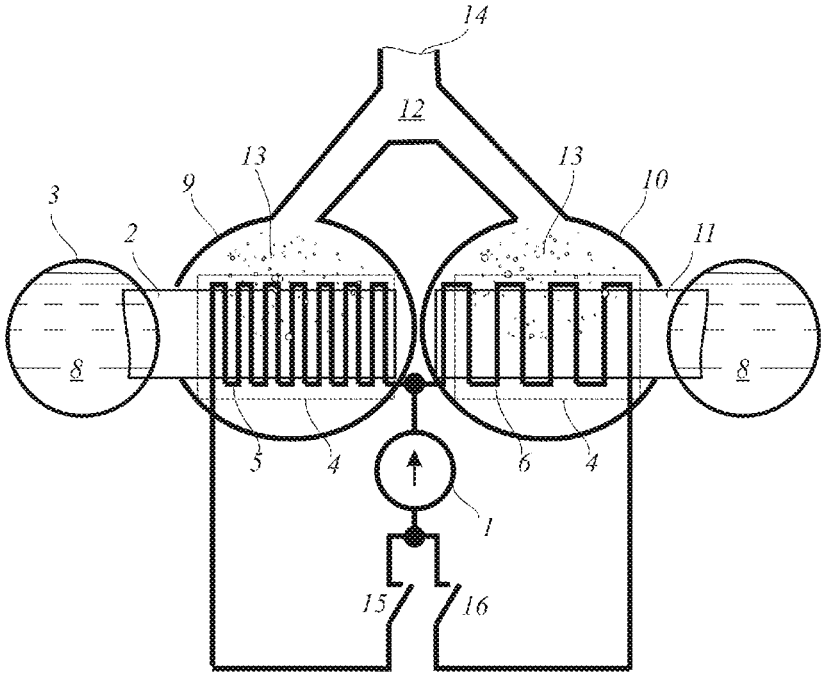
FIG. 2 illustrates a diagram of an alternate connection of the heating sections to a power source in the atomizer with individual housings and separate wicks.
Figure 4:
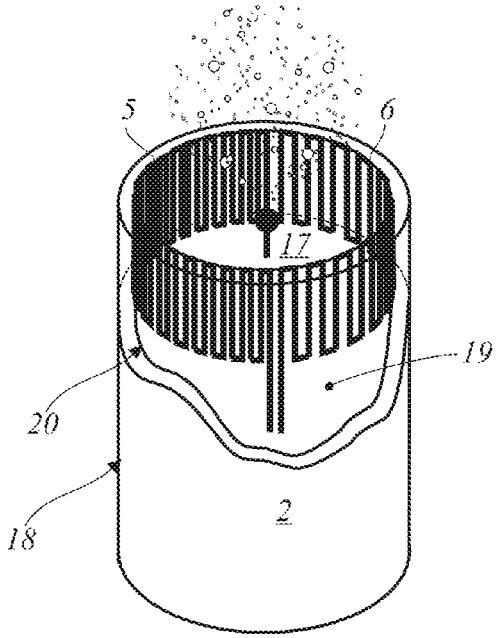
FIG. 4 illustrates a diagram of the heating sections in a vertical design placed in the inner cylindrical cavity of the wick.

In another embodiment as shown in FIG. 2, two heating sections 5, 6 may be located separately from one another in individual housings 9, 10 where the liquid 8 evaporates. In this embodiment each heating section 5, 6 may have two individual wicks 2, 11. The liquid from the wick 2, 11 is evaporated in corresponding individual housing 9, 10 and enters in a collector 12 common for above mentioned housings 9, 10. In the collector 12 the aerosol 13, generated by each of the heating sections 5, 6, mixes with each other and then flows through the channel 14 to the user. Above mentioned heating sections 5, 6 can be made according to the same type of embodiment, for example, tubular, as shown in FIG. 4, but have different electrical parameters (resistance) that directly affect the aerosol 13 generation activity and its property. In this embodiment shown in FIG. 2, above mentioned heating sections 5, 6 may be connected to the power supply 1 alternated by two electronic switches 15, 16.

Alluding to the above, each of the heating sections 5, 6 can be connected to the power supply 1 in turn; when one heating section is connected by the switch 15, the other is disconnected at this time by the switch 16 that allows to adjust the required temperature difference between heating section 5 and 6. The heating sections 5, 6 are connected to the electrical circuit in such a way that they have one common midpoint for supplying electrical potential from a power supply 1 providing electrical power to the atomizer as it is shown in FIG. 2.

Figure 3:
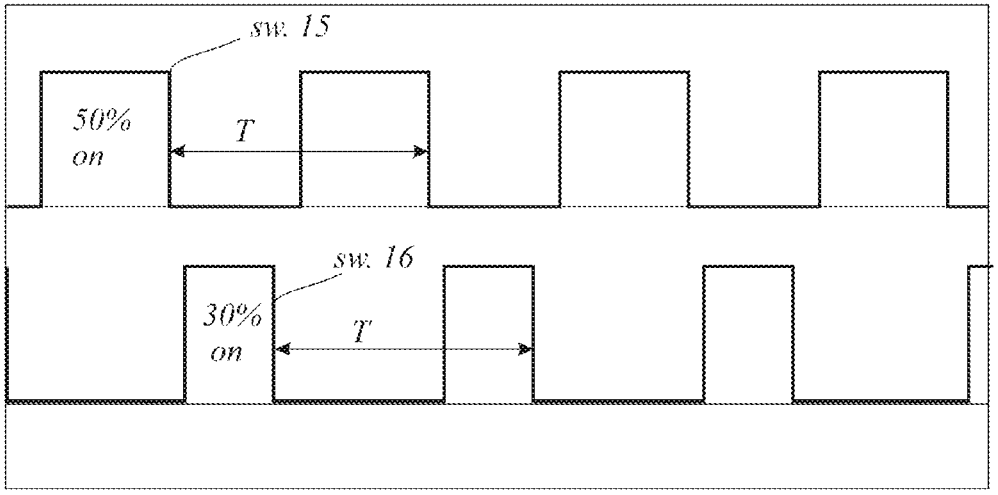
FIG. 3 illustrates a time-diagram showing various duty cycles in a process of temperature regulation of the heating sections.

It is preferable to connect the power supply 1 to each of the heating sections 5, 6 with a high frequency by electronic switches 15, 16 while due to the inertia of the heating zone 4 which will not be able to reduce their temperature to an unacceptable level. In a preferable case both switches 15, 16 can connect the corresponding heating section 5 or 6 according to the method of pulse-width modulation, as it is shown in FIG. 3. The average value of voltage (and current) fed to the heating section 5 or 6 is controlled by turning the switch 15 or 16 at a fast rate. The longer the switch 15 (16) is 'on' compared to the 'off' periods, the higher the total power supplied to the heating section 5 (6). When the switch 15 (16) is 'off' there is practically no current, and when it is 'on' and power is being transferred to the corresponding heating section 5(6) there is almost no voltage drop across the switch 15 or 16.

For example, in FIG. 3, is shown different duty cycles of switches 15 and 16 that describes the proportion of 'on' time to the regular interval or period T of time. A low duty cycle corresponds to low power, because the power is 'off' for most of the time. When the switch 15 is 'on' half of the time T and 'off' the other half of the time T, the transferred power has a duty cycle of 50% and resembles a "square" wave (upper time-diagram in FIG. 3). When the switch 16 spends more time in the 'off' state than the 'on' state, it has a duty cycle of <50%, namely 30% in the bottom time-diagram as shown in FIG. 3.

In a vertical embodiment shown in FIG. 4, the above-mentioned heating sections 5, 6 are located diametrically one opposite the other and form a cylindrical heating zone 17. In this embodiment the above mentioned wick 2 is made of ribbon cotton, wound in such a way that it forms a cylinder, the outer cylindrical side 18 of which is washed by above mentioned liquid 8, and heating sections 5, 6 are installed in the inner cylindrical cavity 19 of the wick 2.

Figure 5:
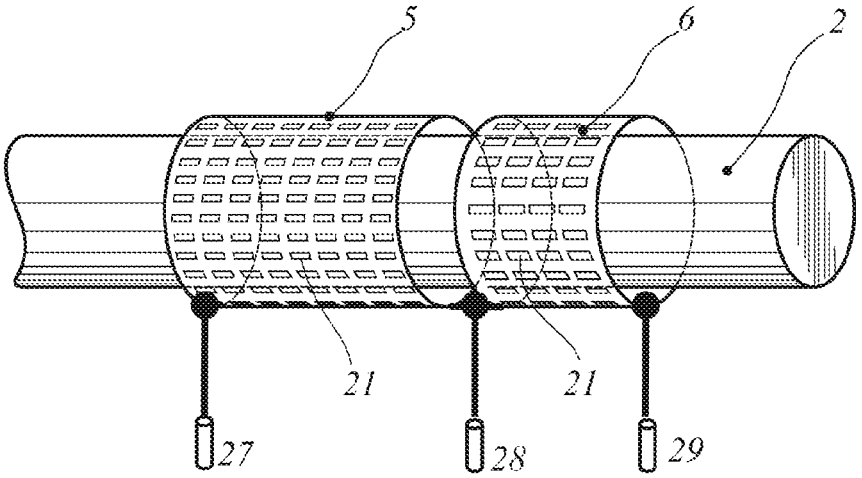
FIG. 5 illustrates a diagram of the heating sections with a mesh structure in a horizontal design.

Moreover, the above mentioned heating sections 5, 6, as shown in FIG. 4, take the shape of a crescent, while they are in close contact with one of their planes with the inner surface 20 of the hollow wick 2, which has a cylindrical shape. In a preferred embodiment, above mentioned heating sections 5, 6 can be made of sheet metal with a thickness from 0.01 mm to 0.1 mm, in which holes 21 are made as it is shown in FIG. 5. Above mentioned holes 21 are located along the entire plane of the above-mentioned heating sections 5, 6 forming a 3D mesh structure as it is shown in FIG. 5.

According to the present invention, the above-mentioned holes 21 may have various shapes: round, square, oval, rectangular, curved, slot-like or hexagonal, without limiting the scope of the present invention. In an preferable option of the embodiment in FIG. 6 all of the heating sections 5, 6 may be made in form of ribbons 22, 23 along edges of which are made cutouts 24, 25 with a different shapes forming an integrated 3D structure of above mentioned differentiated heating sections 5, 6.

Figure 6:
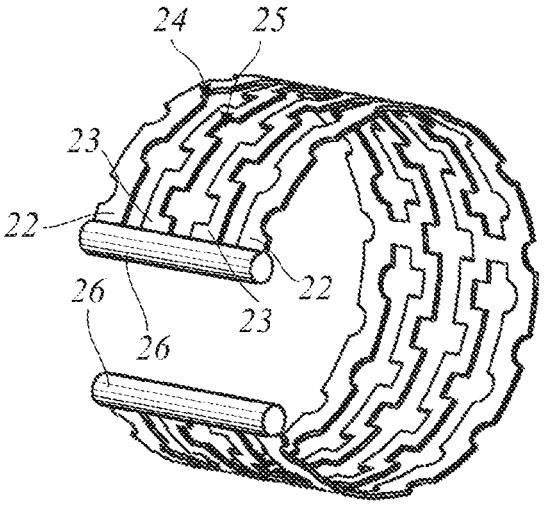
FIG. 6 illustrates a perspective view of an integrated heating section having differentiated heating zones.

In this case, each of the ribbons 22, 23 may have the same width and length and its resistance is defined by the shape and quantity of the cutouts 24, 25. As a rule, above mentioned heating sections 5,6 (22,23) is supplied of resistance-welded wires 26, as shown in FIG. 6, leads along the edges and lead wires function as contact electrodes 27, 28, 29 to which electrical current is applied from the power supply 1 during heating operation. Preferable the above-mentioned wick 1 is made of Silica thread or tape, cotton wool or microporous ceramics, without limiting the scope of the present invention.

Figure 7:
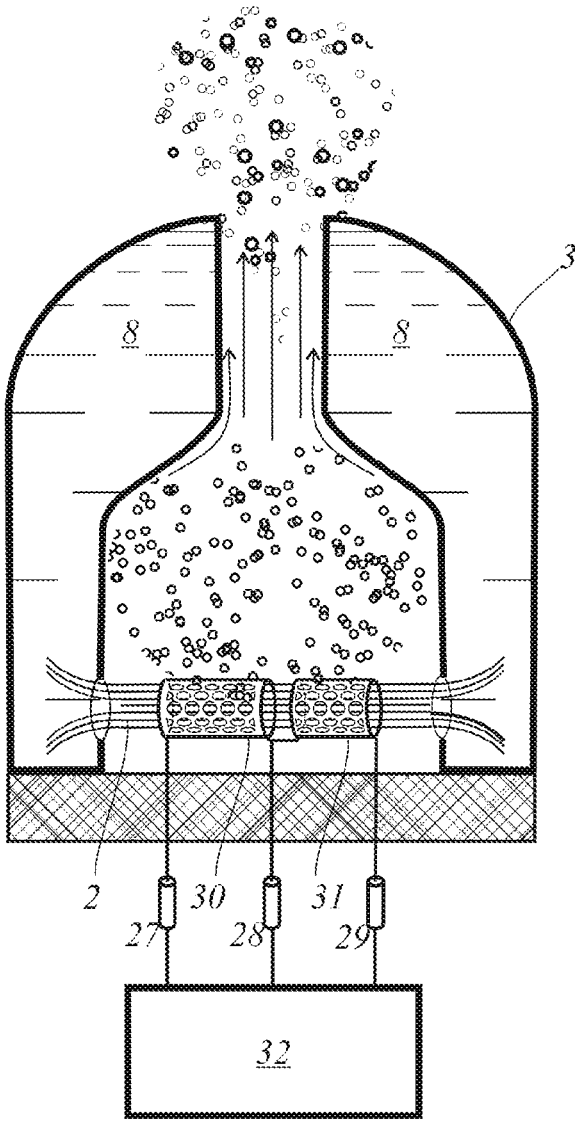
FIG. 7 illustrates a diagram of an option of atomizer with mesh structure of heating sections integrated into the cartridge.

Yet another option of the offered atomizer, as shown in FIG. 7, comprises one common wick 2 for both heating sections that are made of thin-walled metal tubes 30, 31 inside of which the wick 2 is placed. It will be appreciated that the wick 2 is hygroscopic and capable of supplying liquid 8 to both sides to tubular heating sections 30, 31 from the liquid supply container 3 using the capillary effect. Moreover, the above-mentioned tubular heating sections 30, 31 may be supplied with holes as well. In this option of the atomizer embodiment, the above-mentioned contact electrodes 27, 28, 29 of tubular heating sections 30, 31 are connected to output a high frequency current from a generator 32 to provide a skin-effect on the outer surface of the above-mentioned tubular heating sections 30, 31 that allows to reach the necessary resistance of these heating sections.

The use of a heater having two and more heating sections makes it possible to solve the problem in which the aerosol is either insufficiently saturated with the flavoring component, and the user hardly feels the taste (aroma) of the aerosol inhaled by him or the aerosol is insufficient in quantitative terms, that is, the user does not receive a sufficient amount of aerosol when puffing.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. An atomizer comprising:

a power supply;

a wick;

a liquid supply container; and a heating zone including at least two resistive heating sections configured to receive liquid from said liquid supply container via said wick, said at least two resistive heating sections are positioned in line next to one another, and wherein said at least two resistive heating sections are connected in parallel to said power supply.

2. The atomizer as set forth in claim 1, wherein each of said at least two resistive heating sections has said wick.

3. The atomizer as set forth in claim 1, wherein each of said at least two resistive heating sections is disposed within a separate housing, and wherein the housings are connected in fluid communication with one another by a collector.

4. The atomizer as set forth in claim 1, wherein each of said at least two resistive heating sections has a different electrical resistance configured to generate different aerosol property.

5. An atomizer comprising:

a power supply;

a wick;

a liquid supply container; and a heating zone including at least two resistive heating sections configured to receive liquid from said liquid supply container via said wick, said at least two resistive heating sections are positioned diametrically opposite from one another to form a cylindrical heating zone, and wherein said at least two resistive heating sections are connected in parallel to said power supply.

6. The atomizer as set forth in claim 1, wherein said at least two resistive heating sections are connected to said power supply being alternated by an electronic switch and using a pulse-width modulation.

7. The atomizer as set forth in claim 1, wherein said wick is made of ribbon cotton and wound in such a way that said wick forms a cylinder, at least an outer cylindrical side of said wick is washed by the liquid, and said at least two resistive heating sections are installed outside of and in contact with said wick.

8. The atomizer as set forth in claim 5, wherein said at least two resistive heating sections have opposing edges at least one of which is supplied with a resistance-welded wire lead, and wherein the wire lead acts as a contact electrode to which electrical current is applied during heating operation.

9. The atomizer as set forth in claim 1, wherein said at least two resistive heating sections are made of sheet metal.

10. The atomizer as set forth in claim 5, wherein said wick is made of ribbon cotton and wound in such a way that said wick forms a cylinder, at least an outer cylindrical side of said wick is washed by the liquid, and said at least two resistive heating sections are installed in an inner cylindrical cavity of said wick.

11. The atomizer as set forth in claim 10, wherein each of said at least two resistive heating sections has a crescent shape and is in contact with an inner surface of said wick.

12. The atomizer as set forth in claim 5, wherein each of said at least two resistive heating sections is made of a thin sheet metal and each includes a plurality of holes.

13. The atomizer as set forth in claim 5, wherein said at least two resistive heating sections are made in form of ribbons along edges of which are made cutouts with different shapes forming an integrated 3D structure of said at least two resistive heating sections.

14. The atomizer as set forth in claim 5, wherein each of said at least two resistive heating sections forms a 3D mesh structure.

15. The atomizer as set forth in claim 1, wherein said wick is made of Silica thread or tape, a cotton wool or microporous ceramics.

16. An atomizer in tubular form comprising:

a wick;

a liquid supply container;

a plurality of tubular heating sections formed from thin-walled metal tubes with said wick located inside said tubular heating sections, wherein said wick is hygroscopic and capable of supplying liquid from said liquid supply container to both sides of said tubular heating sections via a capillary effect;

wherein contact electrodes of said tubular heating sections are connected to outputs of a high frequency generator to provide a skin-effect on an outer surface of said tubular heating sections.

17. The atomizer as set forth in claim 5, wherein each of said at least two resistive heating sections includes at least one of a round shape, a square shape, an oval shape, a rectangular shape, a curved shape, a slot shape, and a hexagonal shape.

* * * * *